United States Patent [19]

Fujisawa

[11] Patent Number: 4,738,219

[45] Date of Patent: Apr. 19, 1988

[54] COATING APPARATUS

[75] Inventor: Atuhisa Fujisawa, Kobe, Japan

[73] Assignee: Kansai Paint Company, Limited, Hyogo, Japan

[21] Appl. No.: 69,078

[22] Filed: Jul. 2, 1987

[30] Foreign Application Priority Data

Jul. 4, 1986 [JP] Japan ..... 61-158454

[51] Int. Cl.[4] ..... B05C 11/10

[52] U.S. Cl. ..... 118/666; 118/708; 118/326; 427/426

[58] Field of Search ..... 118/666, 708, 326, DIG. 7; 427/426

[56] References Cited

U.S. PATENT DOCUMENTS

| | | | |
|---|---|---|---|
| 2,763,575 | 9/1956 | Bede | 118/326 X |
| 4,019,653 | 4/1977 | Scherer et al. | 222/1 |
| 4,173,924 | 11/1979 | Bradshaw | 118/DIG. 7 |
| 4,258,656 | 3/1981 | Hällgren | 118/666 |
| 4,313,369 | 2/1982 | Tsuruta et al. | 118/DIG. 7 |
| 4,505,945 | 3/1985 | Dubust et al. | 118/666 X |
| 4,687,686 | 8/1987 | Stofleth et al. | 118/326 X |

FOREIGN PATENT DOCUMENTS

| | | | |
|---|---|---|---|
| 902847 | 2/1982 | U.S.S.R. | 118/326 |

*Primary Examiner*—Richard R. Bueker

*Assistant Examiner*—Alain Bashore

*Attorney, Agent, or Firm*—Armstrong, Nikaido, Marmelstein & Kubovcik

[57] ABSTRACT

A coating apparatus comprising a composition feeder for delivering an unadjusted coating composition from a composition source 1 via a composition supply pipe 4, a solvent feeder unit for delivering a solvent from a solvent source 2, 3 via a solvent supply pipe 5, 6, a mixer 18 connected to the composition supply pipe 4 and to the solvent supply pipe 5, 6 for adjusting the viscosity of the coating composition, an applicator 19 for spraying the adjusted coating composition supplied from the mixer 18 and a temperature sensor 14 disposed in a coating booth 13, the solvent feeder unit being provided with a regulator 15 for controlling the supply of the solvent to a predetermined rate in response to a signal from the temperature sensor 14, the solvent feeder unit preferably comprising the two feeders for the high- and low-temperature solvent sources, the apparatus having the advantage that the amount of solvent to be admixed with an unadjusted coating composition can be automatically adjusted to a specified value in accordance with the internal temperature of the coating booth, so that the composition is readily adjustable to a proper viscosity by being mixed with a proper solvent according to variations in the internal booth temperature.

6 Claims, 1 Drawing Sheet

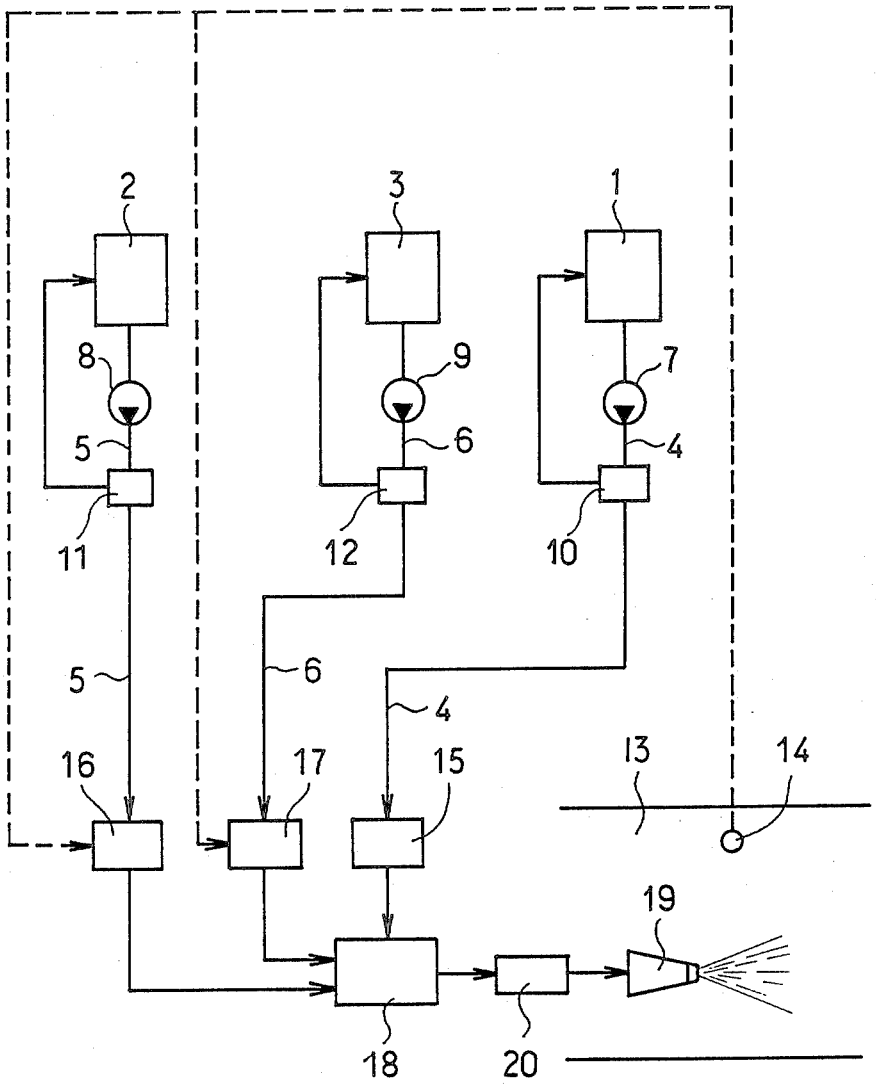
2
3
1
8
9
7
5
6
4
11
12
10
5
6
4
16
17
15
13
14
19
18
20

COATING APPARATUS

BACKGROUND OF THE INVENTION

1. Field of the Invention

The present invention relates to a spray coating apparatus, and more particularly to a coating apparatus of the type by which articles are coated with a spray within a coating booth, for example, for use in coating lines for motor vehicle bodies.

2. Description of the Prior Art

In order to obtain coatings of satisfactory color, the coating composition to be used must be adjusted to a proper viscosity with a proper solvent. The proper solvent for the coating composition and the proper viscosity thereof differ with the internal temperature of the coating booth.

The internal temperature of the coating booth is therefore usually controlled to about 35° C. in summer or to about 20° C. in winter, and the amount of solvent (thinner) and the kind thereof are manually so changed that the composition has a proper viscosity as adjusted to the controlled internal temperature of the booth. Thus, the composition to be used is manually maintained at the proper viscosity.

However, the viscosity adjustment for the coating composition requires many workers. It is also difficult to exquisitely adjust the viscosity of the coating composition, and such adjustment involves problems especially when to be made in accordance with the difference in the internal booth temperature between daytime and nighttime. For example, it is cumbersome to prepare the composition with different viscosities as accurately adjusted for the day and the night. For this reason, it has been conventional practice to adjust the rate of discharge of the composition from the applicator to thereby alter the coating thickness, or to adjust the spray air pressure, in conformity with the temperature difference between the day and the night. The adjustment of the composition discharge rate, nevertheless, produces variations in the coating thickness, while it is not always easy to suitably control the means for adjusting the air pressure.

Further conventionally, the viscosity adjustment is made before the composition is delivered from a composition tank which is the composition source for the applicator, so that in the event of a color change, the previous composition present in the composition tank through the applicator must entirely be replaced by the new one and is therefore wasted in a large quantity. Further because only one kind of adjusted coating composition can be supplied to the applicator connected to a single composition source, both the undercoat and topcoat compositions are applied at the same viscosity, with the result that the applicator fails to apply the composition as adjusted to suitable viscosity of undercoat or topcoat. This becomes a limitation in giving an improved finish.

SUMMARY OF THE INVENTION

The main object of the present invention is to provide a coating apparatus free of the foregoing drawbacks of the prior art.

Stated more specifically, as object of the present invention is to provide a coating apparatus wherein the coating composition is readily adjustable to a proper viscosity with a proper solvent in accordance with variations in the internal temperature of the coating booth and which is usable with a reduced number of persons for the preparation of the proper coating composition.

Another object of the invention is to provide a coating apparatus which permits use of different coating compositions for a color change with greatly diminished waste and wherein different coating compositions are usable, as supplied from a single source and as properly adjusted, for different applicators so as to afford coatings with an improved finish.

Another object of the invention is to provide a coating apparatus which is usable with a coating booth having its interior maintained under the natural temperature condition, i.e., at room temperature, and which nevertheless assures a stable coating operation at room temperature free of color irregularities, the apparatus thus being in conformity with the recent trend of coating techniques toward robotized processes for coating large-sized articles such as motor vehicle bodies.

To fulfill the above objects, the present invention provides a coating apparatus comprising a composition feeder for delivering an unadjusted coating composition from a composition source via a composition supply pipe, a solvent feeder unit for delivering a solvent from a solvent source via a solvent supply pipe, a mixer connected to the composition supply pipe and to the solvent supply pipe for adjusting the viscosity of the coating composition, an applicator for spraying the adjusted coating composition supplied from the mixer and a temperature sensor disposed in a coating booth, the solvent feeder unit being provided with a regulator for controlling the supply of the solvent to a predetermined rate in response to a signal from the temperature sensor.

According to the present invention, the amount of solvent to be admixed with an unadjusted coating composition can be automatically adjusted to a specified value in accordance with the internal temperature of the coating booth, so that the composition is readily adjustable to a proper viscosity by being mixed with a proper solvent according to variations in the internal booth temperature. Further the properly adjusted coating composition can be prepared by a greatly reduced number of persons. In the case of a coating line having a capacity of 15000 passenger motor vehicle bodies per month (24-hour operation), for example, the preparation of coating compositions conventionally requires five persons but can be done by two persons according to the invention.

Further with the present invention, coating compositions of proper viscosity can be prepared immediately before the applicator in the coating booth, using a specified solvent in a specified amount according to the internal temperature of the booth. This greatly diminishes the waste of the composition involved in a color change.

Thus, coating compositions of proper viscosity can be automatically prepared with the use of a proper solvent in accordance with variations in the internal temperature of the booth, with the result that the coating booth can be maintained at room temperature to carry out a stable coating operation free of irregularities in coating thickness and in color.

Further according to the present invention, the amount of solvent to be admixed with an unadjusted composition is adjustable for each of the applicators within the coating booth. This enables the applicators to apply the composition as adjusted to the undercoat or topcoat, giving an improved finish to the coating and achieving a higher operation efficiency.

The invention will be described below with reference to the accompanying drawing which is given for illustrative purpose only and to which the invention is not limited.

BRIEF DESCRIPTION OF THE DRAWING

The drawing is a piping diagram showing an embodiment of the invention.

DESCRIPTION OF THE PREFERRED EMBODIMENT

An embodiment of the invention will be described below with reference to the accompanying drawing.

The illustrated apparatus of the invention comprises a composition source tank 1 containing a coating composition which is not adjusted to a proper viscosity, a first solvent source tank 2 containing a solvent for use at high temperatures, and a second solvent source tank 3 containing a solvent for use at low temperatures. A composition supply pipe 4, a solvent supply pipe 5 and a solvent supply pipe 6 extend from the composition tank 1, the first solvent tank 2 and the second solvent tank 3, respectively. The pipes 4, 5, 6 are provided, each at an intermediate portion thereof, with pumps 7, 8, 9 of the constant flow type, respectively. These pipes and pumps are assembled into a composition feeder and solvent feeders. When required, the pumps 7, 8, 9 are respectively provided at the delivery side thereof with relief valves 10, 11, 12 having return pipes connected to the tanks 1, 2, 3.

A booth 13 for coating articles, such as motor vehicle bodies, in its interior has a temperature sensor 14 therein for detecting the internal temperature of the booth 13. The forward ends of the supply pipes 4, 5, 6 from the tanks 1, 2, 3 are connected via a mixer 18 to an applicator 19 equipped with a spray gun. The applicator 19 generally comprises a computer-controllable robot with the spray gun mounted thereon, but can be one which is manually operated. The composition supply pipe 4 is provided with a regulator 15, and the solvent pipes 5, 6 with regulators 16, 17, respectively. Usable as the regulator 15 is a flow control valve (which can be of the fixed-flow or variable-flow type), such as a throttle valve, for controlling the flow rate of the coating composition so as to form a coating of required thickness on the article to be coated. The regulators 16, 17 are electrically or electronically connected to the temperature sensor 14 and are controllable in accordance with the internal temperature of the coating booth 13 detected by the sensor 14. Usable as each of the regulators 16, 17 is a throttle valve having an orifice controllable according to the detected temperature, or a cylinder or rotary pump for giving a controlled flow rate according to the detected temperature. Indicated at 20 is a shut-off valve.

The illustrated apparatus operates in the following matter.

The regulators 16, 17 are controlled via a telemeter according to the internal temperature of the coating booth 13 detected by the temperature sensor 14, whereby the rate of flow of the solvent flowing through each of the solvent supply pipes 5, 6 into the mixer 18 is automatically controlled to a predetermined value. An unadjusted coating composition is fed to the mixer 18 through the composition supply pipe 4 and the regulator 15 at a rate preset on the regulator 15.

The regulators 16, 17 on the solvent supply pipes 5, 6 are used singly or in combination depending on a particular temperature range in which the internal temperature of the booth 13 is included. For example, the regulator 16 on the pipe 5 from the first solvent tank 2 is operated when the internal temperature is higher than 35° C. (e.g. 35° to 40° C.) (in summer), the regulator 17 on the pipe 6 from the second solvent tank 3 is operated when the internal temperature is lower than 10° C. (e.g. 5° to 10° C.) (in winter), or both the regulators 16, 17 are operated when the temperature is between these temperature ranges (in spring and fall). For this purpose, the temperature range for the supply operation by the regulator 16 is set to at least 10° C., and that for the regulator 17 is set to not higher than 35° C. It therefore follows that in the intermediate temperature range between the ranges of 10° C. and 35° C., the solvents are supplied from both the first and second solvent tanks 2, 3 at proper rates. Alternatively, the lower limit of the temperature range for the supply operation by the regulator 16 can be made to substantially coincide with the upper limit of the temperature range for the regulator 17. The solvent is then supplied only from one of the solvent tanks 2, 3.

Thus, the coating composition is supplied from the mixer 18 to the applicator 19, as automatically adjusted to a proper viscosity based on proper kinds and amount of solvents in accordance with the internal temperature of the booth 13 by the solvent flow control afforded by the regulator 16 and/or the regulator 17.

What is claimed is:

1. A coating apparatus comprising a composition feeder for delivering an unadjusted coating composition from a composition source via a composition supply pipe, a solvent feeder unit for delivering a solvent from a solvent source via a solvent supply pipe, a mixer connected to the composition supply pipe and to the solvent supply pipe for adjusting a viscosity of the coating composition, an applicator for spraying the adjusted coating composition supplied from the mixer and a temperature sensor disposed in a coating booth, the solvent feeder unit being provided with a regulator for controlling the supply of the solvent to a predetermined rate in response to a signal from the temperature sensor.

2. A coating apparatus as defined in claim 1 wherein the solvent feeder unit comprises a first solvent feeder for delivering a solvent from a high-temperature solvent source via a first supply pipe and a second solvent feeder for delivering a solvent from a low-temperature solvent source via a second supply pipe, the first solvent feeder being provided with a first regulator for delivering a proper amount of supply from the first solvent feeder when the temperature detected by the temperature sensor is not lower than a preset value, the second solvent feeder being provided with a second regulator for delivering a proper amount of supply from the second solvent feeder when the temperature detected by the temperature sensor is lower than a preset value.

3. A coating apparatus as defined in claim 2 wherein the preset values for the first and second regulators are equal so that the solvent is supplied to the mixer from only one of the solvent feeders.

4. A coating apparatus as defined in claim 2 wherein the preset value for the first regulator is lower than the preset value for the second regulator to provide an intermediate temperature range for delivering a proper amount of supply from both the solvent feeders.

5. A coating apparatus as defined in claim 1 wherein the regulator is provided with a throttle valve for controlling an orifice in the solvent supply pipe.

6. A coating apparatus as defined in claim 1 wherein the regulator is provided with a pump controllable in the rate of delivery and connected to the solvent supply pipe.

* * * * *